US010933957B2

(12) United States Patent
Doyon et al.

(10) Patent No.: US 10,933,957 B2
(45) Date of Patent: Mar. 2, 2021

(54) HULL FOR A PERSONAL WATERCRAFT AND METHOD FOR MOLDING SAME

(71) Applicant: BOMBARDIER RECREATIONAL PRODUCTS INC., Valcourt (CA)

(72) Inventors: Guillaume Doyon, Sherbrooke (CA); Denis Formosa, Granby (CA); Philippe Marcoux, Sherbrooke (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 16/778,248

(22) Filed: Jan. 31, 2020

(65) Prior Publication Data

US 2020/0247507 A1 Aug. 6, 2020

Related U.S. Application Data

(60) Provisional application No. 62/799,604, filed on Jan. 31, 2019.

(51) Int. Cl.

| | |
|---|---|
| ***B63B 34/10*** | (2020.01) |
| ***B63B 5/24*** | (2006.01) |
| ***B63B 3/09*** | (2006.01) |

(52) U.S. Cl.

CPC ..... *B63B 34/10* (2020.02); *B63B 3/09* (2013.01); *B63B 5/24* (2013.01)

(58) Field of Classification Search

CPC ..... B63B 34/00; B63B 34/10; B63B 5/00; B63B 5/24; B63B 3/00; B63B 3/09; B63B 35/00; B63B 35/71

USPC ..... 114/357

See application file for complete search history.

(56) References Cited

U.S. PATENT DOCUMENTS

| | | | | |
|---|---|---|---|---|
| 4,065,820 | A * | 1/1978 | Starratt, Jr. | B29C 66/721 114/357 |
| 7,841,915 | B2 | 11/2010 | Bourret et al. | |
| 9,567,037 | B2 * | 2/2017 | Preisler | B63B 5/24 |
| 9,770,849 | B2 * | 9/2017 | Preisler | B29C 43/18 |
| 9,873,488 | B2 * | 1/2018 | Preisler | B63B 5/24 |
| 2012/0315429 | A1 * | 12/2012 | Stamp | B29C 70/028 428/72 |

* cited by examiner

*Primary Examiner* — Lars A Olson
(74) *Attorney, Agent, or Firm* — BCF, LLP

(57) ABSTRACT

A hull for a personal watercraft includes a compression-molded hull body. A main portion of the hull body includes a thermoplastic material embedded with non-directional chopped glass fibers. The main portion extends along an entirety of the length and of the width of the hull body. Port and starboard portions of the hull body include the thermoplastic material embedded with directional glass fibers. The directional glass fibers include longitudinally-oriented glass fibers. A majority of the longitudinally-oriented glass fibers have a length at least ten times greater than a mean length of the chopped glass fibers. The port and starboard portions extend vertically from proximate an upper edge of the hull towards a keel, and longitudinally along at least 50% of the length of the hull body.

21 Claims, 12 Drawing Sheets

HULL FOR A PERSONAL WATERCRAFT AND METHOD FOR MOLDING SAME

CROSS-REFERENCE

The present application claims priority to U.S. Provisional Patent Application No. 62/799,604, filed on Jan. 31, 2019, the entirety of which is incorporated herein by reference.

FIELD OF THE INVENTION

The present invention relates to a hull for a personal watercraft, and to a method for molding the hull.

BACKGROUND OF THE INVENTION

A hull of a personal watercraft (PWC) supports the PWC in the water and is formed to have a particular shape which imparts to the PWC certain handling characteristics. Notably, a hull body of the hull is molded from a composite material including a polymer reinforced with glass fibers.

Various molding techniques can be employed to form the hull body of the PWC. For instance, in some molding techniques, a thermosetting polymer resin embedded with chopped glass fibers is sprayed into an open mold cavity (defined by a female half of the mold) which is shaped to define an outer surface of the hull body. An inner surface of the hull body is then formed either by closing the mold with a male half thereof or by rolling the resin with rollers to push air out of the resin. An alternative molding technique involves using sheets made of a resin including a thermosetting polymer embedded with chopped glass fibers and a catalyst. These sheets are cut into shape and placed in a mold. By applying heat and pressure on the mold, the resin of the sheets liquefies and the curing process is activated.

More recently, compression molding has been employed to mold the hull body of a PWC from a thermoplastic embedded with chopped glass fibers. Notably, thermoplastic materials have the advantage of being recyclable in addition to being less expensive and lighter than thermosetting materials. However, while such compression-molded thermoplastic hulls have been successfully implemented for small hull bodies, using the same technique to mold larger hull bodies is challenging as defects arise in the material composition of the hull bodies which can affect their strength. More specifically, it has been found that compression molding thermoplastic hulls for PWCs can result in resin flow during molding that aligns chopped glass fibers in particular in areas along the port and starboard sides of the hull, proximate the shear line.

In view of the foregoing, there is a need for a hull for a PWC including a thermoplastic hull body which addresses at least in part some of these defects.

SUMMARY OF THE INVENTION

It is an object of the present invention to ameliorate at least some of the inconveniences present in the prior art.

According to one aspect of the present technology, there is provided a hull for a personal watercraft. The hull includes a compression-molded hull body having a length between about 2 and 4 meters, a width between about 0.75 and 1.5 meters and a depth between about 0.25 and 1 meters. The hull body defines a bow; a stern opposite the bow; a laterally centered keel; and a port side and a starboard side extending on opposite sides of the keel. The hull body includes: a main portion including a thermoplastic material embedded with non-directional chopped glass fibers, the main portion extending along an entirety of the length of the hull body and an entirety of the width of the hull body; and port and starboard portions including the thermoplastic material embedded with directional glass fibers, the directional glass fibers including longitudinally-oriented glass fibers. A majority of the longitudinally-oriented glass fibers have a length at least ten times greater than a mean length of the chopped glass fibers. The port portion extends along the port side. The starboard portion extends along the starboard side. Each of the port and starboard portions extends vertically from proximate an upper edge of the hull towards the keel, and longitudinally along at least 50% of the length of the hull body.

In some embodiments of the present technology, each of the port and starboard portions extends longitudinally along at least 60% of the length of the hull body.

In some embodiments of the present technology, each of the port and starboard portions extends longitudinally forward from proximate the stern.

In some embodiments of the present technology, the hull also includes a port side chine and a starboard side chine, the port and starboard portions extending vertically lower than a corresponding one of the port and starboard side chines.

In some embodiments of the present technology, each of the port and starboard portions extends vertically along at least 50% of the depth of the hull body.

In some embodiments of the present technology, the hull body has an inner surface and an outer surface; and the port and starboard portions extend along the inner surface.

In some embodiments of the present technology, the main portion defines the outer surface of the hull body.

In some embodiments of the present technology, the main portion defines the bow, the stern, the keel, an outer portion of the port side and an outer portion of the starboard side. The port portion defines an inner portion of the port side. The starboard portion defines an inner portion of the starboard side.

In some embodiments of the present technology, the directional glass fibers in the port and starboard portions further include vertically-oriented glass fibers extending generally perpendicular to the longitudinally-oriented glass fibers.

In some embodiments of the present technology, each of the port and starboard portions further comprises a plurality of layers stacked along a thickness of the hull body. The plurality of layers includes: a first layer containing a first set of the longitudinally-oriented glass fibers; a second layer containing the vertically-oriented glass fibers; and a third layer containing a second set of the longitudinally-oriented glass fibers. The second layer is disposed between the first layer and the third layer.

In some embodiments of the present technology, the thermoplastic material is polypropylene.

In some embodiments of the present technology, the hull body also defines at least one of strengthening ribs and motor mounts. The at least one of the strengthening ribs and the motor mounts are formed by the thermoplastic material embedded with non-directional chopped glass fibers. None of the at least one of the strengthening ribs and the motor mounts are formed by the port and starboard portions.

In some embodiments, the longitudinally-oriented glass fibers make up a majority of the directional glass fibers.

According to one aspect of the present technology, there is provided a method for compression molding a hull body for a personal watercraft. The method includes: sizing preformed sheets of a thermoplastic material embedded with longitudinally-oriented glass fibers such that the preformed sheets extend along at least 50% of a length of the hull body; placing the preformed sheets into a mold at locations of the mold corresponding to port and starboard sides of the hull body; placing in the mold deposits of a thermoplastic resin embedded with non-directional chopped glass fibers, a majority of the longitudinally-oriented glass fibers having a length that is at least ten times greater than a mean length of the chopped glass fibers; and closing the mold and applying pressure thereto such that the thermoplastic resin embedded with non-directional chopped glass fibers of the deposits fills the mold and the thermoplastic material of the preformed sheets fuses with the thermoplastic resin of the deposits which then solidifies as a thermoplastic material.

In some embodiments of the present technology, the preformed sheets are placed onto a male half of the mold such that the thermoplastic material of the preformed sheets forms part of an inner surface of the hull body.

In some embodiments of the present technology, the preformed sheets are sized to extend along at least 60% of the length of the hull body.

In some embodiments of the present technology, the preformed sheets are placed into the mold to extend longitudinally forward from proximate a stern of the hull body.

In some embodiments of the present technology, the preformed sheets are placed into the mold such that the thermoplastic material of the preformed sheets extends vertically from proximate an upper edge of the hull body towards a keel of the hull body.

In some embodiments of the present technology, the preformed sheets are placed into the mold such that the thermoplastic material of the preformed sheets extends vertically between port and starboard chines of the hull body and a keel of the hull body.

In some embodiments of the present technology, the preformed sheets are placed into the mold such that the thermoplastic material of the preformed sheets extends vertically along at least 50% of a height of the hull body.

In some embodiments of the present technology, the thermoplastic material of the preformed sheets is further embedded with vertically-oriented glass fibers extending generally perpendicular to the longitudinally-oriented glass fibers.

For purposes of this application, the terms related to spatial orientation such as forwardly, rearward, left and right, are as they would normally be understood by a driver of a vehicle sitting thereon in a normal driving position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
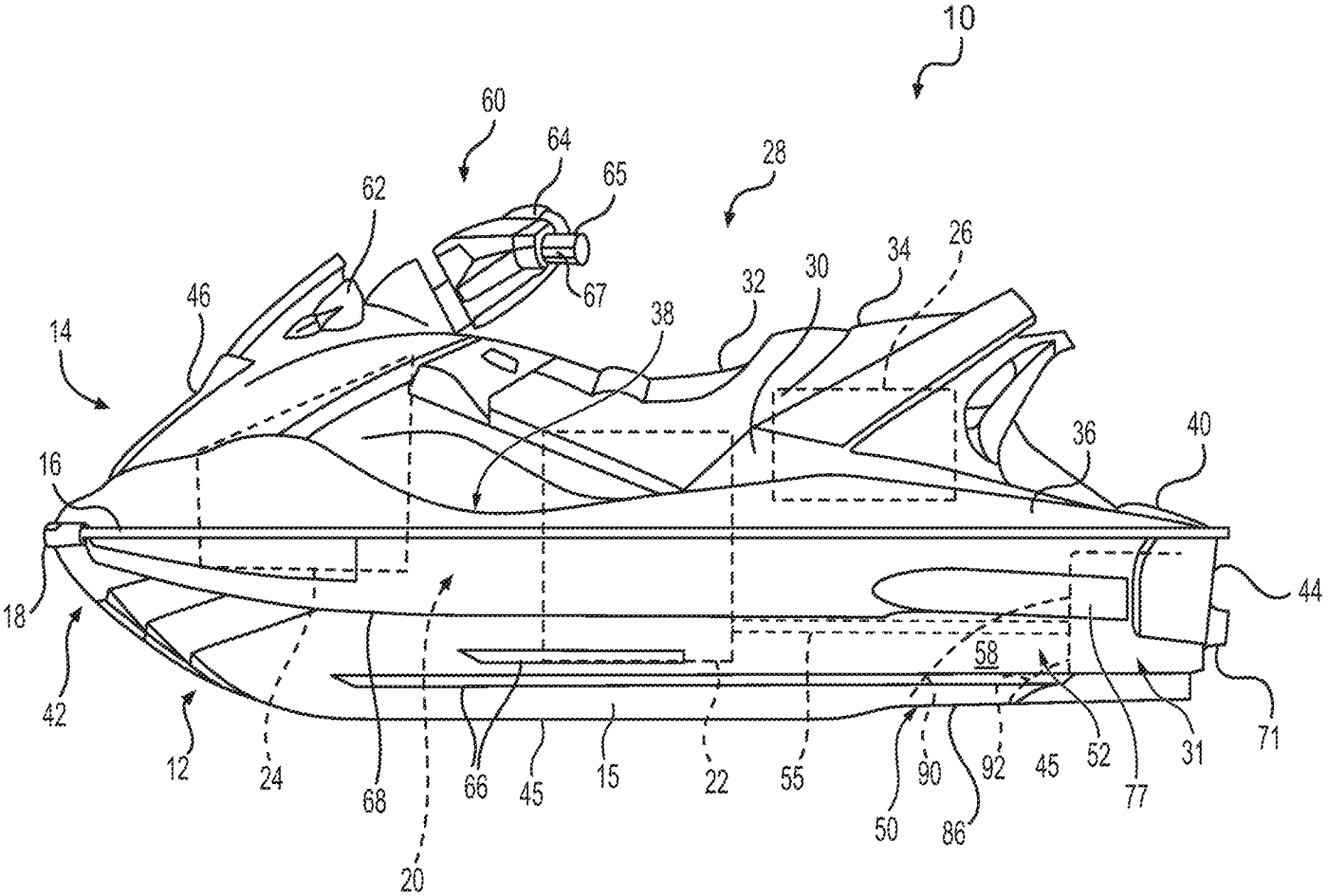
FIG. 1 is a left side elevation view of a personal watercraft in accordance with an embodiment of the present technology.

A personal watercraft 10 in accordance with one embodiment of the present technology is shown in FIGS. 1 to 5. The following description relates to one example of a personal watercraft. Those of ordinary skill in the art will recognize that there are other known types of personal watercraft incorporating different designs and that the present technology would encompass these other watercraft.

The watercraft 10 has a hull 12 and a deck 14. The hull 12 buoyantly supports the watercraft 10 in the water. A hull body 15 of the hull 12 defines a bow 42 and a stern 44 opposite the bow 42, as well as a laterally centered keel 45. The hull body 15 and a method of manufacture thereof will be described in greater detail below. In the present embodiment, the hull body 15 has a length L of between about 2 and 4 meters, a width W of between about 0.75 and 1.5 meters, and a depth D of between about 0.25 and 1 meters (see FIGS. 4, 5 and 7).

The deck 14 is designed to accommodate one or multiple riders. The hull 12 and the deck 14 are joined together at a seam 16 that joins the parts in a sealing relationship. A bumper 18 generally covers the seam 16, which helps to prevent damage to the outer surface of the watercraft 10 when the watercraft 10 is docked, for example.

As seen in FIG. 1, the deck 14 has a centrally positioned straddle-type seat 28 positioned on top of a pedestal 30 to accommodate multiple riders in a straddling position. The seat 28 includes a front seat portion 32 and a rear, raised seat portion 34. The seat 28 is preferably made as a cushioned or padded unit, or as interfitting units. The front and rear seat portions 32, 34 are removably attached to the pedestal 30. The seat portions 32, 34 can be individually tilted or removed completely. Seat portion 32 covers a motor access opening defined by a top portion of the pedestal 30 to provide access to a motor 22 (shown schematically in FIG. 1). Seat portion 34 covers a removable storage bin 26 (FIG. 1). A small storage box is provided in front of the seat 28.

Figure 2:
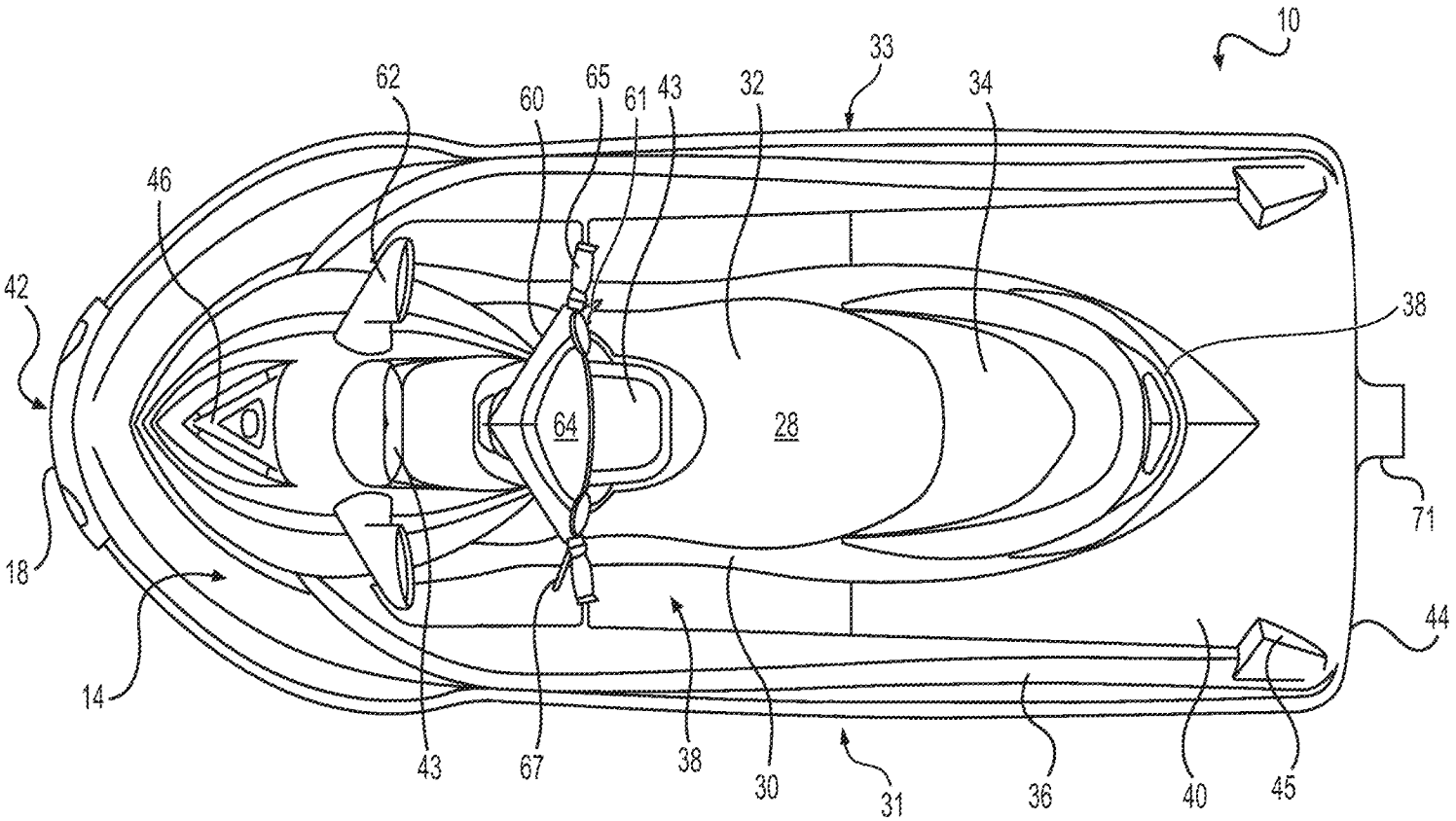
FIG. 2 is a top plan view of the watercraft of FIG. 1.

The watercraft 10 has a pair of generally upwardly extending walls located on either side of the watercraft 10 known as gunwales or gunnels 36. The gunnels 36 help to prevent the entry of water in the footrests 38 of the watercraft 10, provide lateral support for the riders' feet, and also provide buoyancy when turning the watercraft 10, since the personal watercraft 10 rolls slightly when turning. Towards the rear of the watercraft 10, the gunnels 36 extend inwardly to act as heel rests 45 (FIG. 2). A passenger riding the watercraft 10 facing towards the rear, to spot a water-skier for example, may place his or her heels on the heel rests 45, thereby providing a more stable riding position. Heel rests 45 could also be formed separately from the gunnels 36.

Located on both sides of the watercraft 10, between the pedestal 30 and the gunnels 36, are the footrests 38. The footrests 38 are designed to accommodate the riders' feet in various riding positions. The footrests 38 are covered by carpeting made of a rubber-type material, for example, to provide additional comfort and traction for the feet of the riders.

A reboarding platform 40 is provided at the rear of the watercraft 10 on the deck 14 to allow the rider or a passenger to easily reboard the watercraft 10 from the water. Nonslip mats or some other suitable covering may cover the reboarding platform 40. A retractable ladder (not shown) may be affixed to a transom 47 (FIG. 4) of the stern 44 to facilitate boarding the watercraft 10 from the water onto the reboarding platform 40.

As seen in FIG. 1, the watercraft 10 is provided with a hood 46 located forwardly of the seat 28 and a helm assembly 60. A hinge (not shown) is attached between a forward portion of the hood 46 and the deck 14 to allow the hood 46 to move to an open position to provide access to a front storage bin 24. A latch (not shown) located at a rearward portion of the hood 46 locks the hood 46 into a closed position. When in the closed position, the hood 46 prevents water from entering the front storage bin 24. Rearview mirrors 62 are positioned on either side of the hood 46 to allow the rider to see behind the watercraft 10. A hook 59 is located at the bow 42 of the watercraft 10 (FIG. 2). The hook 59 is used to attach the watercraft 10 to a dock when the watercraft 10 is not in use or to attach to a winch when loading the watercraft 10 on a trailer, for instance.

As best seen in FIG. 2, the helm assembly 60 is positioned forwardly of the seat 28. The helm assembly 60 has a central helm portion 64, that is padded, and a pair of steering handles 65, also referred to as a handlebar. One of the steering handles 65 is provided with a throttle operator 61, which allows the rider to control the motor 22, and therefore the speed of the watercraft 10. The throttle operator 61 is a finger-actuated throttle lever. However, it is contemplated that the throttle operator 61 could be a thumb-actuated throttle lever or a twist grip. The throttle operator 61 is movable between an idle position and multiple actuated positions. In this embodiment, the throttle operator 61 is biased towards the idle position, such that, should the driver of the watercraft 10 let go of the throttle operator 61, it will move to the idle position. The other of the steering handles 65 is provided with a reverse gate operator 67 used by the driver to actuate a reverse gate 63 (FIG. 5) of the watercraft 10. The reverse gate operator 67 is a finger-actuated lever. However, it is contemplated that the reverse gate operator 67 could be a thumb-actuated lever or a twist grip.

The helm assembly 60 is provided with a key receiving post (not shown) located near a center of the central helm portion 64. The key receiving post is adapted to receive a key that starts the watercraft 10. It should be noted that the key receiving post may be placed in any suitable location on the watercraft 10.

As shown in FIG. 2, a display area or cluster 43 is located forwardly of the helm assembly 60. The display cluster 43 can be of any conventional display type, including a liquid crystal display (LCD), dials or LED (light emitting diodes). The central helm portion 64 has various buttons, which could alternatively be in the form of levers or switches, that allow the driver to modify the display data or mode (speed, engine rpm, time, etc.) on the display cluster 43 or to change a condition of the watercraft 10, such as trim (the pitch of the watercraft 10).

As shown schematically in FIG. 1, the motor 22 is supported by the hull 12 and is enclosed within a motor compartment 20 defined between the hull 12 and the deck 14. The motor 22 is configured for driving a jet propulsion system 50 (also commonly referred to as a "jet pump drive") which propels the watercraft 10. The motor compartment 20 accommodates the motor 22, as well as a muffler, gas tank, electrical system (battery, electronic control unit, etc.), air box, storage bins 24, 26, and other elements required or desirable in the watercraft 10. In this embodiment, the motor 22 is an internal combustion engine 22 and will thus be referred to as the engine 22. However, it is contemplated that, in alternative embodiments, the engine 22 may be any other suitable type of motor such as an electric motor. As will be understood, in such an embodiment, certain components would be added to or omitted from the watercraft 10 (e.g., no muffler and gas tank, etc.).

As mentioned above, the watercraft 10 is propelled by the jet propulsion system 50 which pressurizes water to create thrust. To that end, the jet propulsion system 50 has a duct 52 (FIG. 1) in which water is pressurized and which is defined by various components of the jet propulsion system 50, including an intake ramp 58, an impeller housing (not shown), and a steering nozzle 71 of the jet propulsion system 50. A driveshaft 55 is connected between the engine 22 and an impeller (not shown) of the jet propulsion system 50. A bellow assembly (not shown) is mounted to the driveshaft 55 and provides a seal between the duct 52 and the hull 12 such as to prevent entry of water into the hull.

Figure 3:
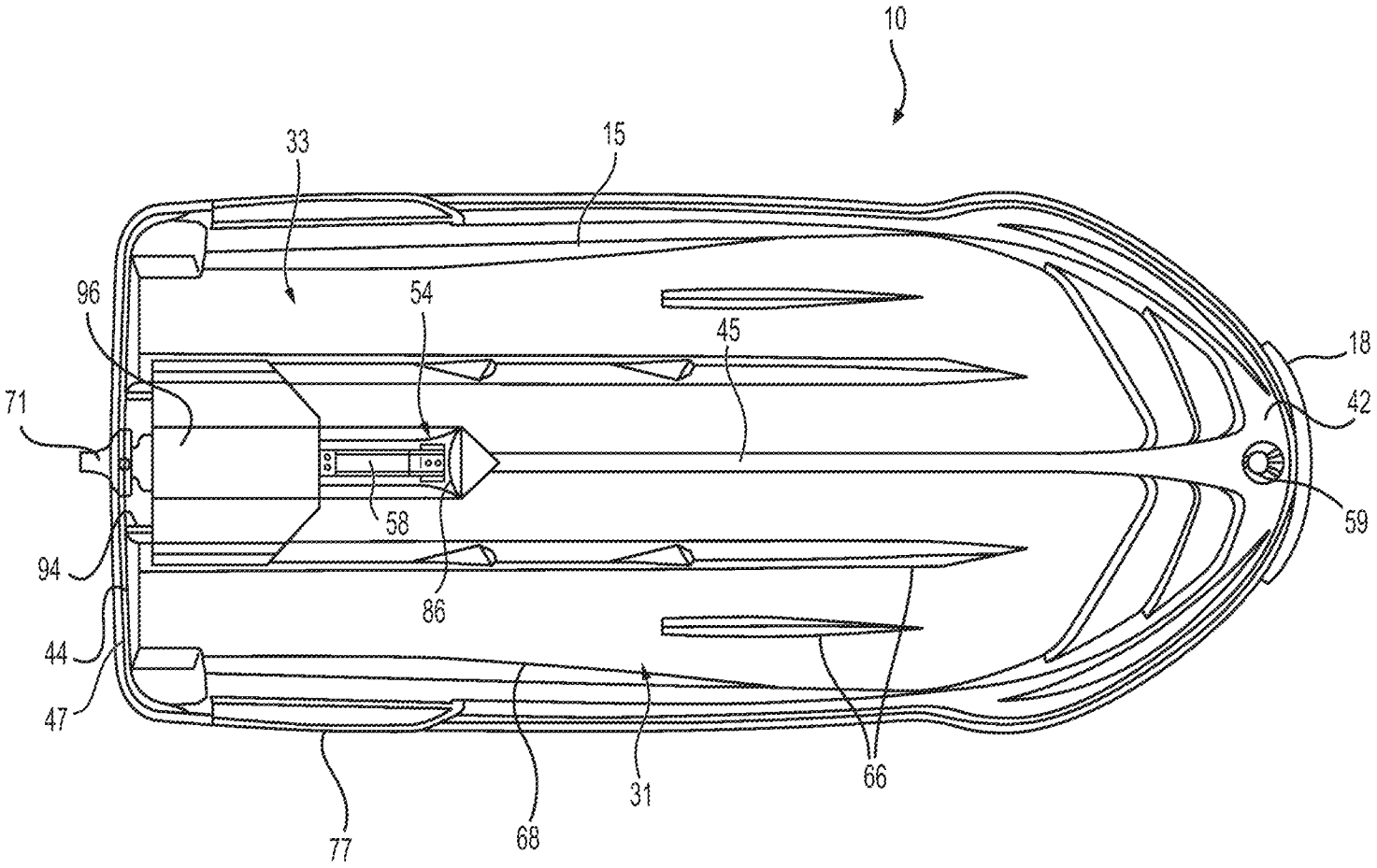
FIG. 3 is a bottom plan view of the watercraft of FIG. 1.
Figure 4:
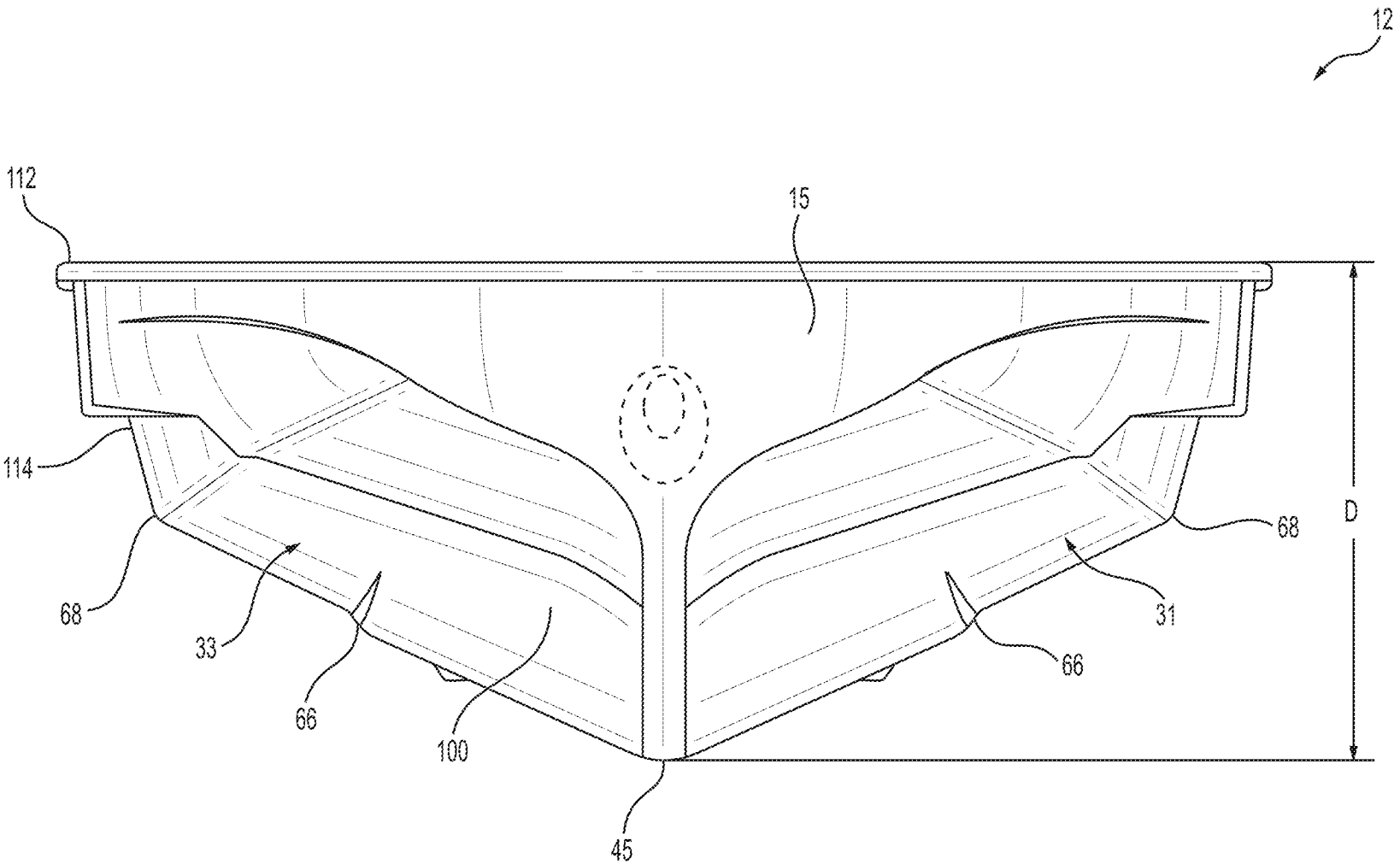
FIG. 4 is a front elevation view of a hull of the watercraft of FIG. 1.
Figure 5:
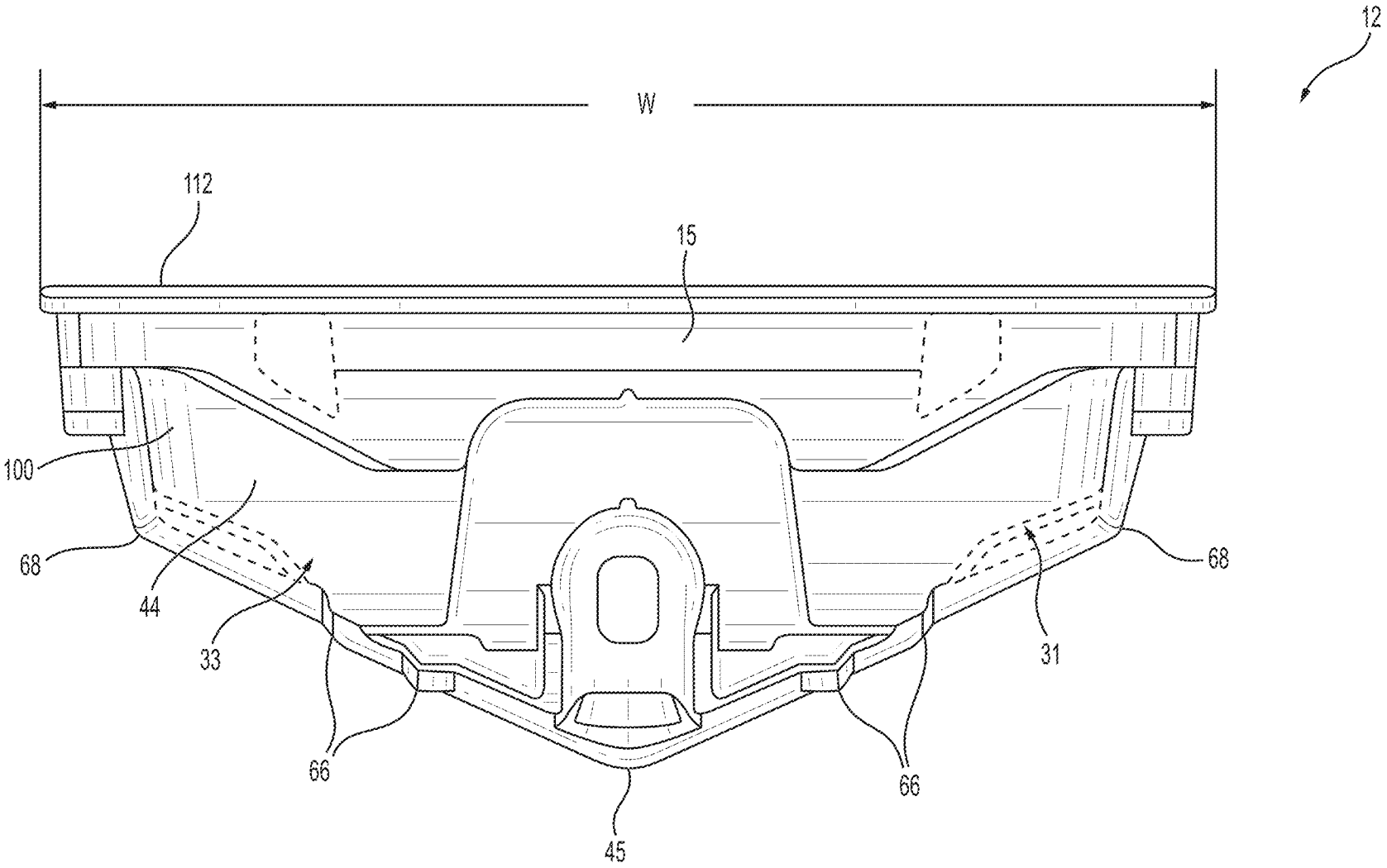
FIG. 5 is a rear elevation view of the hull of FIG. 4.
Figure 6:
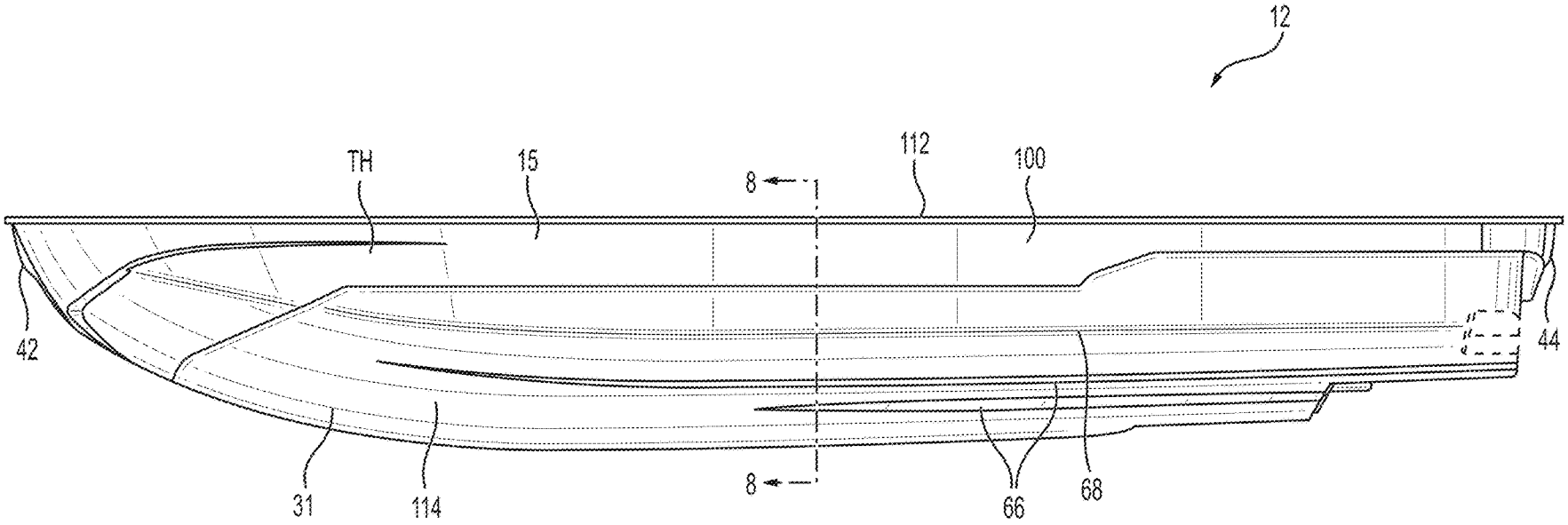
FIG. 6 is a left side elevation view of the hull of FIG. 4.

As best seen in FIG. 3, the duct 52 has an inlet 86 positioned under the hull 12. When the jet propulsion system 50 is in operation, water is first scooped into the inlet 86. An inlet grate 54 is positioned adjacent (i.e., at or near to) the inlet 86 and is configured to prevent large rocks, weeds, and other debris from entering the jet propulsion system 50, which may damage the system or negatively affect performance. It is contemplated that the inlet grate 54 could be positioned in the inlet 86. Water flows from the inlet 86 through the intake ramp 58. The intake ramp 58 has a top portion 90 that is formed by the hull 12 and a bottom portion 92 that is formed by a ride shoe (not shown).

The watercraft 10 is also provided with a reverse gate (not shown) which is movable between a stowed position where it does not interfere with the jet of water being expelled rearwardly along the duct 52 by the jet propulsion system 50 and a plurality of positions where it redirects the jet of water being expelled rearwardly along the duct 52 by the jet propulsion system 50. Notably, the reverse gate can be actuated into a neutral position in which the thrust generated by the jet propulsion system 50 does not have a horizontal component such that the watercraft 10 will not be accelerated or decelerated by the thrust and will stay in position if it was not moving prior to moving the reverse gate in the neutral position. The reverse gate can also be actuated into a reverse position as it redirects the jet of water towards the front of the watercraft 10, thus causing the watercraft 10 to move in a reverse direction.

A reverse gate actuator (not shown), in the form of an electric motor, is operatively connected to the reverse gate to move the reverse gate. The reverse gate actuator could alternatively be any one of a mechanical, a hydraulic, or another type of electric actuator. One contemplated reverse gate actuator is shown and described in U.S. Pat. No.

7,841,915, issued Nov. 30, 2010, the entirety of which is incorporated herein by reference.

The hull body 15 will now be described in greater detail. As shown in FIGS. 1 to 3, the hull body 15 has a combination of strakes 66 and chines 68 on each of a port side 31 and a starboard side 33 of the hull body 15. The port and starboard sides 31, 33 extend on opposite sides of the keel 45. A strake 66 is a protruding portion of the hull body 15. A chine 68 is the vertex formed where two surfaces of the hull body 15 meet. The combination of strakes 66 and chines 68 provide the watercraft 10 with its riding and handling characteristics.

Sponsons 77 (FIGS. 1 and 3) are located on both the port and starboard sides of the hull body 15 near the transom 47. The sponsons 77 have an undersurface that gives the watercraft 10 both lift while in motion and improved getting on plane and handling characteristics. In this embodiment, the sponsons 77 are fixed to the surface of the hull body 15 and can be attached thereto by fasteners. It is contemplated that the position of the sponsons 77 with respect to the hull body 15 may be adjustable to change the handling characteristics of the watercraft 10 and accommodate different riding conditions.

Figure 7:
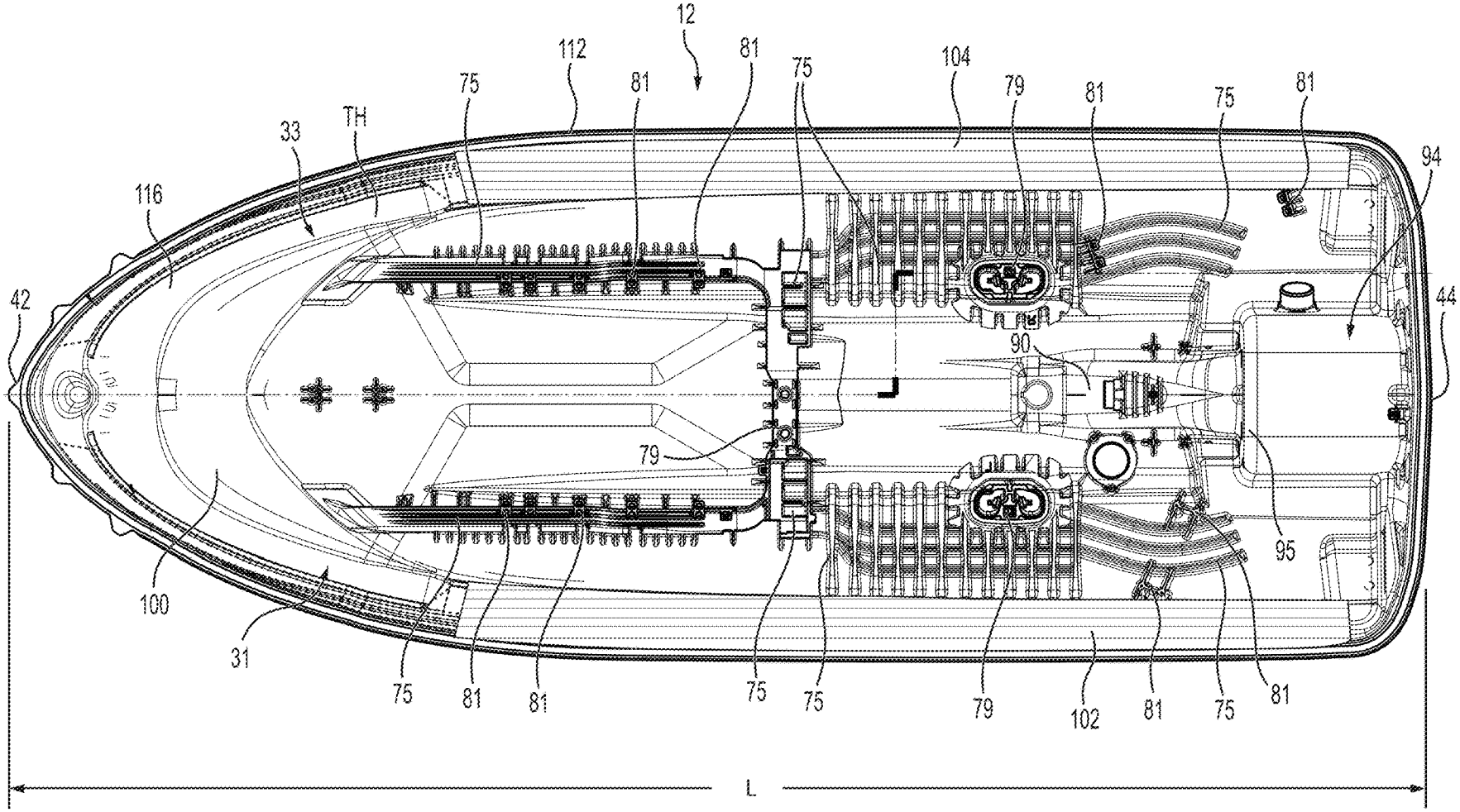
FIG. 7 is a top plan view of the hull of FIG. 4.

As shown in FIGS. 3 and 7, the hull body 15 defines a tunnel 94 in which part of the jet propulsion system 50 is received. The tunnel 94 is defined at the front (i.e. front wall 95, FIG. 7), sides and top by the hull body 15 and is open at the transom 47. The bottom of the tunnel 94 is closed by a ride plate 96 of the hull 12. The ride plate 96 creates a surface on which the watercraft 10 rides or planes at high speeds.

On the inner side of the hull body 15, as shown in FIG. 7, the hull body 15 also defines a plurality of strengthening ribs 75 extending both generally laterally and generally longitudinally, a plurality of motor mounts 79 for mounting the engine 22 and a plurality of brackets 81 for fixing other components of the watercraft 10 therewithin. One set of the strengthening ribs 75 is located on each of the port and starboard sides 31, 33. Two of the three motor mounts 79 are located on each of the port and starboard sides 31, 33, while the third, forwardmost motor mount 79 is located more centrally.

Figure 8:
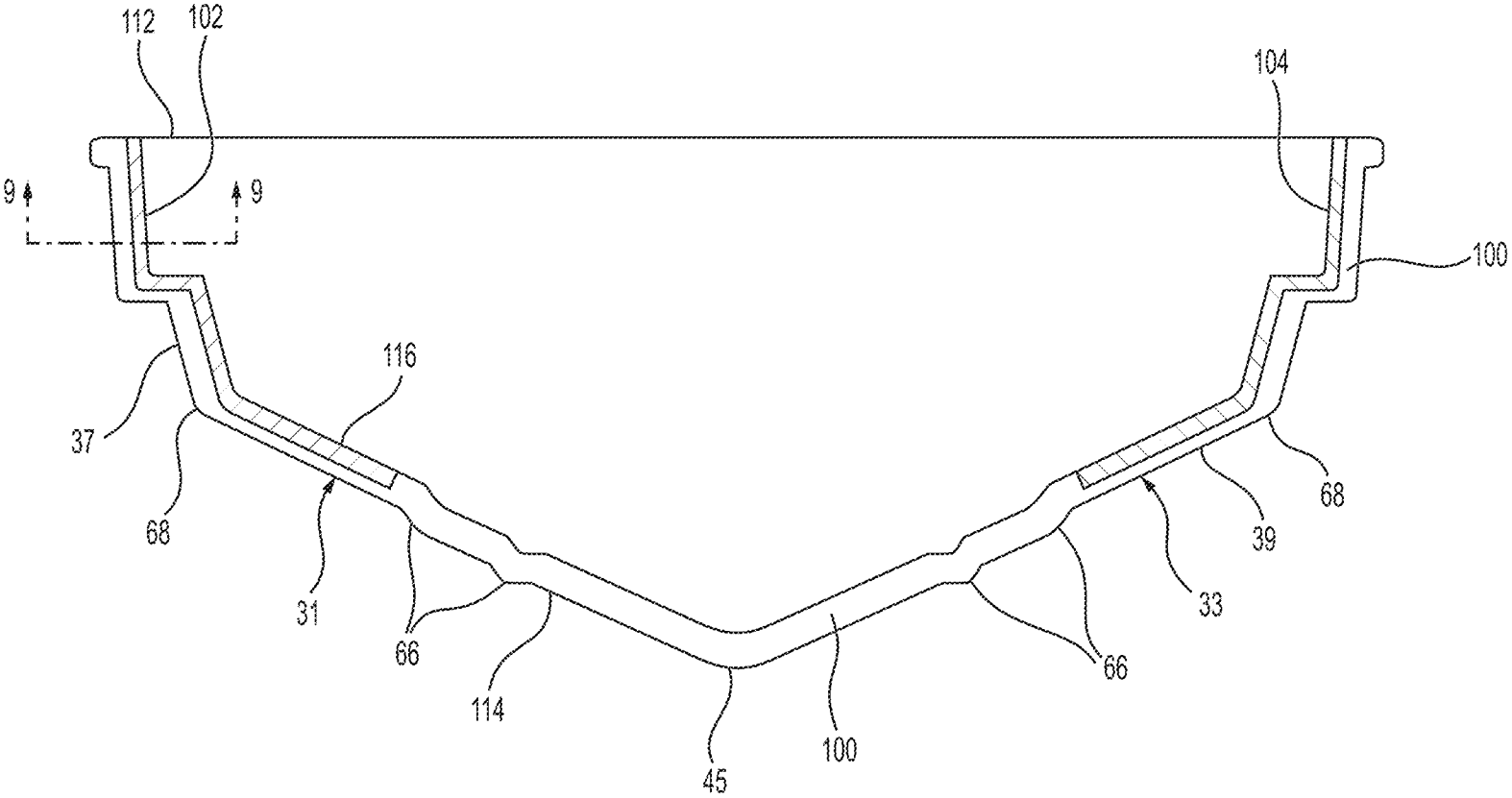
FIG. 8 is a cross-sectional view of the hull of FIG. 4 taken along line 8-8 in FIG. 6.

As will be described below, the hull body 15 is molded from a thermoplastic resin such that the hull body 15 is made of a thermoplastic material TH which extends throughout the hull body 15. In this embodiment, the thermoplastic material TH of the hull body 15 is polypropylene, which, as will be appreciated by one skilled in the art, encompasses a family of polypropylene thermoplastic polymer materials and can include various additives that enhance the molding process and/or the final molded product's physical properties. However, it is contemplated that the thermoplastic material TH may be any other suitable thermoplastic material in other embodiments. The thermoplastic material TH is embedded with fibers which have varying configurations in different portions of the hull body 15 such that the different portions of the hull body 15 have varying material properties. Notably, as shown in FIGS. 7 and 8, in this embodiment, the hull body 15 has a main portion 100, and port and starboard portions 102, 104. As will be explained below, the port and starboard portions 102, 104 have different material properties from the main portion 100.

The main portion 100 extends along an entirety of the width W and an entirety of the length L of the hull body 15 and thus is the principal component of the hull body 15. Notably, the main portion 100 defines the bow 42, the stern 44, the keel 45, an outer portion 37 of the port side 31 and an outer portion 39 of the starboard side 33 (see FIG. 8). As such, the main portion 100 defines an outer surface 114 of the hull body 15. The main portion 100 also forms the strengthening ribs 75 and the motor mounts 79 on the inner side of the hull body 15.

The port and starboard portions 102, 104 extend along the port and starboard sides 31, 33 respectively. The port and starboard portions 102, 104 overlap selected sections of the main portion 100 and thus are provided to supplement the main portion 100 on the port and starboard sides 31, 33.

The port and starboard portions 102, 104 are configured in a similar manner to one another, being mirror images of one another on the port and starboard sides 31, 33. As such, only the port portion 102 will be described in detail herein with respect to the structure of the hull body 15 on the port side 31. It is to be understood that, unless otherwise specified, the same description applies to the starboard portion 104 with respect to the starboard side 33.

As shown in FIG. 8, the port portion 102 extends vertically from proximate an upper edge 112 of the hull body 15 (also referred to as a "shear line") towards the keel 45. More specifically, the port portion 102 extends vertically from proximate the upper edge 112 of the hull body 15 to a point vertically lower than the chine 68 on the port side 31. Notably, in this embodiment, the port portion 102 extends vertically along at least 50% of the depth D (FIG. 4) of the hull body 15. Longitudinally, the port portion 102 also extends along a substantial part of the length L of the hull body 15. For instance, as shown in FIG. 7, in this embodiment, the port portion 102 extends along about 65% of the length L of the hull body 15. In other embodiments, the port portion 102 may extend along at least 50% of the length L of the hull body 15. It is also contemplated that, in some embodiments, the port portion 102 may extend longitudinally along 60% or more of the length L of the hull body 15. Moreover, in this embodiment, the port portion 102 extends longitudinally forward from proximate the stern 44. As can be seen in FIG. 7, the rear end of the port portion 102 is rearward of the front wall 95 of the tunnel 94.

As shown in FIGS. 7 and 8, the port portion 102 extends along an inner surface 116 of the hull body 15 (opposite the outer surface 114). However, none of the strengthening ribs 75, motor mounts 79 or brackets 81 are formed by the port portion 102 as in the present embodiment the port portion 102 terminates at a location of the hull body 15 above the strengthening ribs 75 and the motor mounts 79.

The material compositions of the main portion 100 and the port portion 102 will now be described with reference to FIG. 9. It is to be understood that the proportions illustrated in the Figures showing the compositions of the main portion 100 and the port portion 102 have been exaggerated to facilitate understanding.

Both the main portion 100 and the port portion 102 comprise the same thermoplastic material TH. Nevertheless, in order to readily identify the part of the thermoplastic material TH that is part of the main portion 100 and that which is part of the port portion 102, in FIG. 9 the thermoplastic material TH of the main portion 100 has been identified as the thermoplastic material $TH_1$ while the thermoplastic material TH of the port portion 102 has been identified as the thermoplastic material $TH_2$. As will be explained below in the context of the molding process of the hull body 15, there is no clear demarcation between the thermoplastic material $TH_1$ of the main portion 100 and the thermoplastic material $TH_2$ of the port portion 102 in the finalized hull body 15, rather it is the glass fibers therein that distinguish the main and port portions 100, 102 in the finalized hull body 15.

As can be seen, the thermoplastic material $TH_1$ of the main portion 100 is embedded with non-directional chopped glass fibers 106. The chopped glass fibers 106 are "non-directional" in that, throughout a majority of the main portion 100, the chopped glass fibers 106 are not oriented in any particular direction. Rather, the chopped glass fibers 106, which are relatively short in length (about 4 cm long), are oriented randomly within the thermoplastic material TH and thus extend in all directions. As such, the strength of the main portion 100 is generally isotropic throughout a majority of the main portion 100. It should be understood that, due to the manner in which the hull body 15 is molded, in some regions of the main portion 100, the chopped glass fibers 106 may acquire a certain directionality. However, for simplicity, all of the chopped glass fibers 106 have been illustrated herein as being oriented randomly in consistency with the significant majority of the main portion 100.

The thermoplastic material $TH_2$ of the port portion 102 is embedded with directional glass fibers 108, 110. The directional glass fibers 108, 110 are "directional" in that they are specifically oriented in a given direction. Notably, the directional glass fibers 108, 110 include a plurality of longitudinally-oriented glass fibers 108 and a plurality of vertically-oriented glass fibers 110. The longitudinally-oriented glass fibers 108 are "longitudinally-oriented" in that they extend generally longitudinally while the vertically-oriented glass fibers 110 are "vertically-oriented" in that they extend primarily vertically (i.e., primarily along a depth direction of the hull body 15). The vertically-oriented glass fibers 110 extend generally perpendicular to the longitudinally-oriented glass fibers 108. For instance, the vertically-oriented glass fibers 110 can form an angle between 80° and 100° relative to the longitudinally-oriented glass fibers 108.

In this embodiment, the longitudinally-oriented glass fibers 108 make up a majority of the directional glass fibers 108, 110 (i.e., the port portion 102 has more of the longitudinally-oriented glass fibers 108 than the vertically-oriented glass fibers 110). In fact, it is contemplated that, in some embodiments, the vertically-oriented glass fibers 110 may be omitted. Nevertheless, it is also contemplated that, in some embodiments, the directional glass fibers 108, 110 may be made of up of equal portions of longitudinally-oriented glass fibers 108 and vertically-oriented glass fibers 110, or that the vertically-oriented glass fibers 110 make up a majority of the directional glass fibers 108, 110.

The directional glass fibers 108, 110 are substantially longer than the chopped glass fibers 106 of the main portion 100. For instance, as shown in FIG. 9, a majority of the longitudinally-oriented glass fibers 108 have a length LF2 that is at least ten times greater than a mean length LF1 of the chopped glass fibers 106. The longitudinally-oriented glass fibers 108 may be even greater than ten times longer than the chopped glass fibers 106 in other embodiments. The diameters of the chopped glass fibers 106 and the directional glass fibers 108, 110 are the same in this embodiment.

It should be noted that while the longitudinally-oriented glass fibers 108 are provided as continuous fibers at the start of the molding process (which will be described in greater detail below), the longitudinally-oriented glass fibers 108 may break during the molding process. However, the length LF2 of the longitudinally-oriented glass fibers 108 will be at least ten times greater than the mean length LF1 of the chopped glass fibers 106, even after any breaking during molding.

Figure 9:
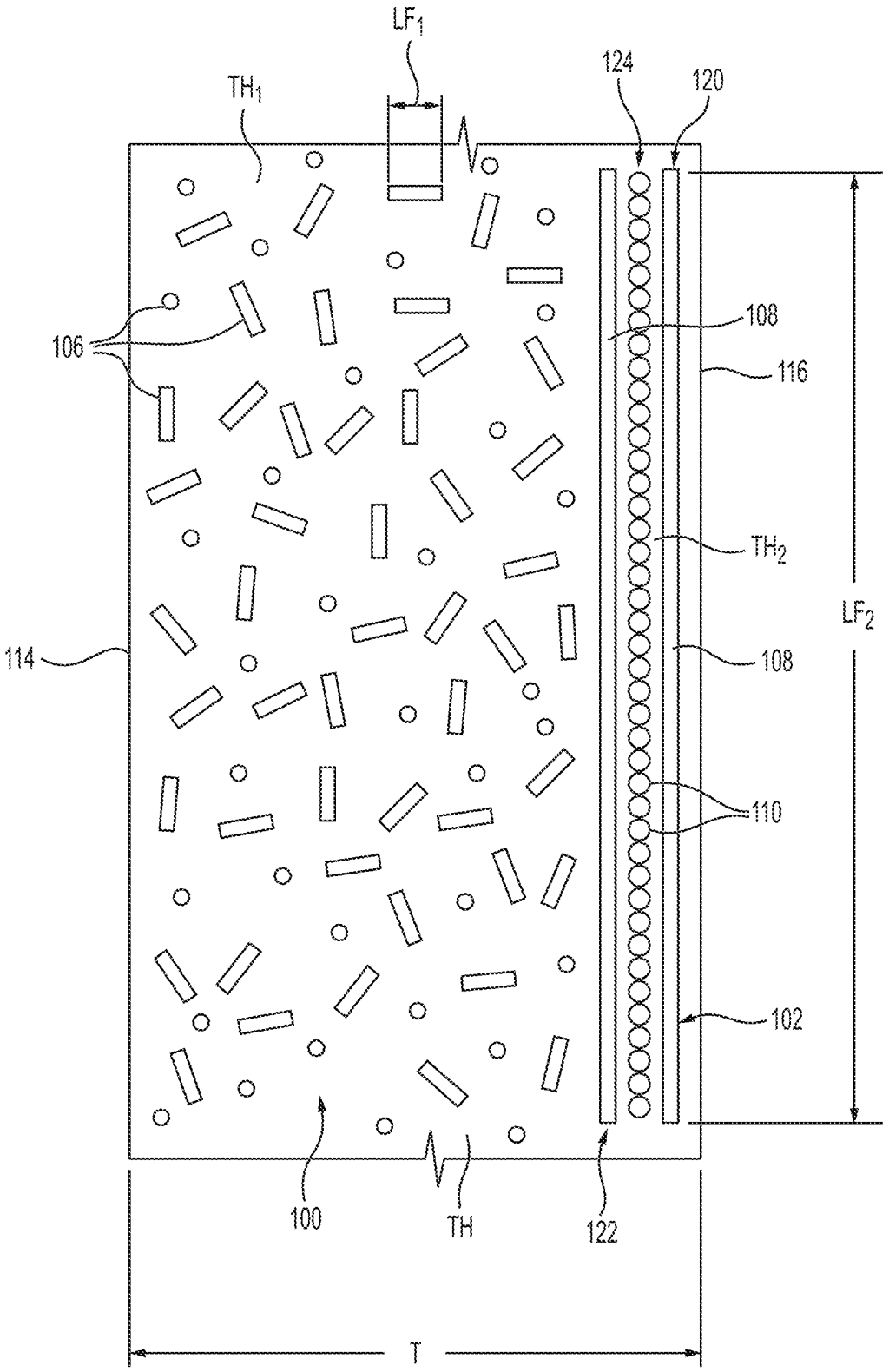
FIG. 9 is a cross-sectional view of part of the hull of FIG. 4 taken along line 9-9 in FIG. 8.

With continued reference to FIG. 9, in this embodiment, the port portion 102 has a plurality of layers stacked along a thickness T of the hull body 15 which include given ones of the directional glass fibers 108, 110. Notably, the port portion 102 has an inner layer 120 containing a set S1 of the longitudinally-oriented glass fibers 108, an outer layer 122 containing a set S2 of the longitudinally-oriented glass fibers 108, and a middle layer 124 disposed between the inner and outer layers 120, 122 and containing the vertically-oriented glass fibers 110. It is contemplated that, in some embodiments, rather than having two layers containing the longitudinally-oriented glass fibers 108 and one layer containing the vertically-oriented glass fibers 110, two of the layers (for example, the inner and outer layers 120, 122) could contain respective sets of the vertically-oriented glass fibers 110 and one of the layers (for example, the middle layer 124) could contain a set of the longitudinally-oriented glass fibers 108. Furthermore, it is contemplated that fewer or additional layers could be provided in other embodiments. For instance, in some embodiments, an additional layer may be provided containing a set of the vertically-oriented glass fibers 110.

The hull body 15 is compression molded in accordance with a method which will now be described in detail with reference to FIGS. 10 to 12.

Figure 14:
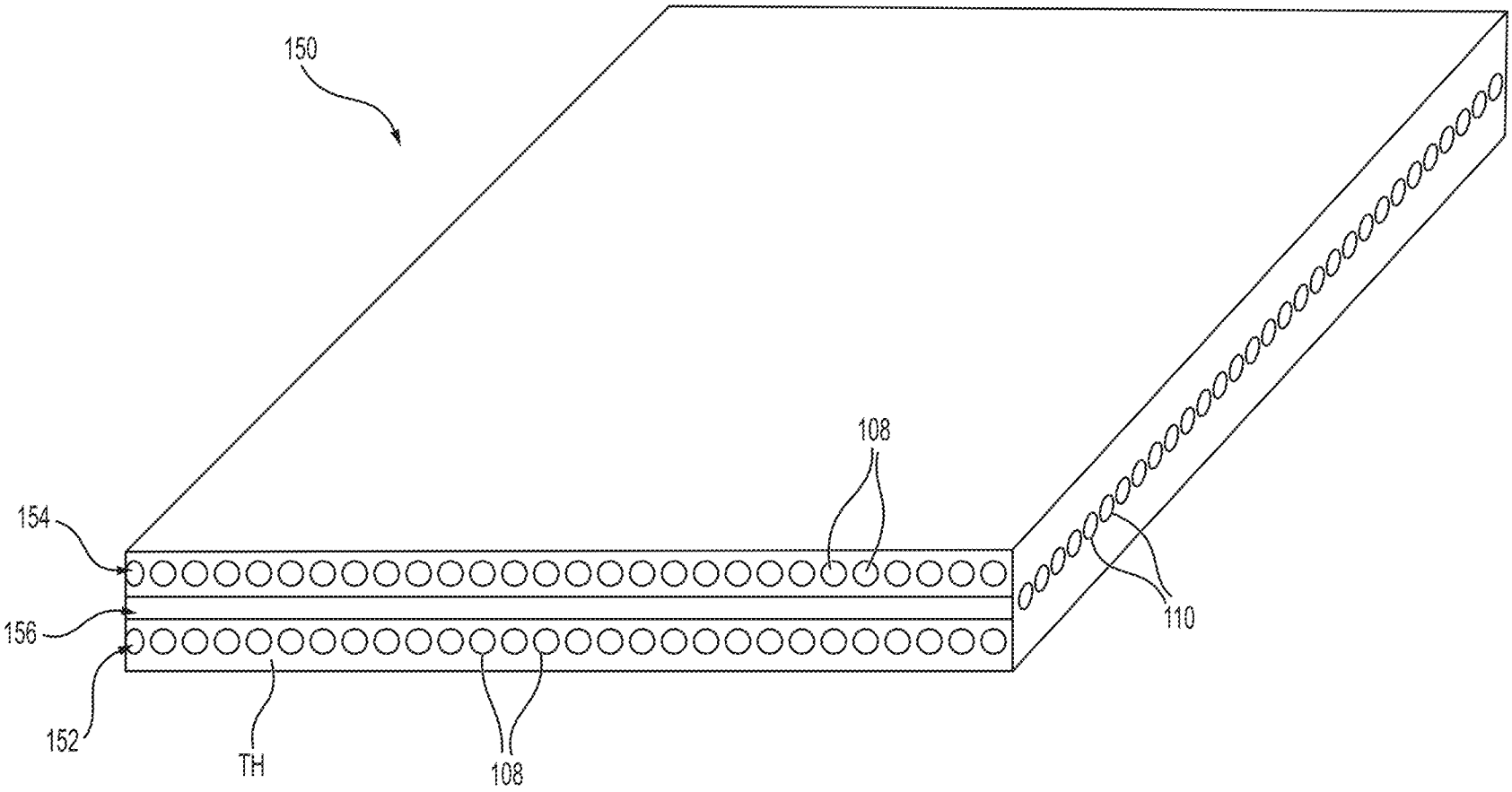
FIG. 14 is a perspective view of part of a preformed sheet used for molding the hull body of the hull of FIG. 4.

In order to manufacture the hull body 15, preformed sheets 150 are provided to form the port and starboard portions 102, 104. As shown in FIG. 14, each of the preformed sheets 150 is made of the thermoplastic material TH embedded with the directional glass fibers 108, 110. As described above, the glass fibers 110 extend generally perpendicular to the glass fibers 108. The glass fibers 108, 110 are stacked in three layers 152, 154, 156 along a thickness of the preformed sheet 150. The layers 152, 154 contain the glass fibers 108 while the layer 156 contains the glass fibers 110. Notably, the layers 152, 154, 156 of the preformed sheet 150 correspond to the layers 120, 122, 124 of the port portion 102 described above.

The preformed sheets 150 are "preformed" in that they are formed as flat solid sheets prior to insertion into a mold 200 used to form the hull body 15. Such preformed sheets 150 are commercially available for example from Polystrand®. In this embodiment, the preformed sheets 150 have approximately 60% glass by weight. This value may vary in other embodiments. For instance, in some embodiments, the preformed sheets 150 may have between 50% to 70% glass by weight. Moreover, the preformed sheets 150 are relatively thin. For instance, in this embodiment, the preformed sheets 150 have a thickness of less than 1 mm. More specifically, in this embodiment, the preformed sheets 150 have a thickness of approximately 0.7 mm.

It is contemplated that, in some embodiments, rather than having a single preformed sheet 150 to form a corresponding one of the port and starboard portions 102, 104, multiple preformed sheets 150 may be stacked atop one another to have thicker port and starboard portions 102, 104. Furthermore, it is contemplated that each of the preformed sheets 150 may include only selected ones of the layers 152, 154, 156. For example, in some embodiments, a preformed sheet 150 may contain a single one of the layers 152, 154, 156 such that the glass fibers 108 or 110 of the preformed sheet 150 extend in a single direction. In such embodiments, two or more of the preformed sheets 150 may be stacked atop one another to obtain the stacked layers 152, 154, 156.

Once procured, the preformed sheets 150 are sized (e.g., cut) in accordance with the desired lengths of the port portion 102 and starboard portions 104 as described above.

Notably, in this embodiment, the preformed sheets 150 are sized to extend at least 50% of the length L of the hull body 15. As discussed above with respect to the port portion 102, in some embodiments, the preformed sheets 150 may be sized to extend along 60% or more of the length L of the hull body 15. It is contemplated that more than one of the preformed sheets 150 may form each of the port and starboard portions 102, 104. For instance, two or more preformed sheets 150 may be sized such that their combined lengths are equal to the desired length of any one the port and starboard portions 102, 104.

Figure 10:
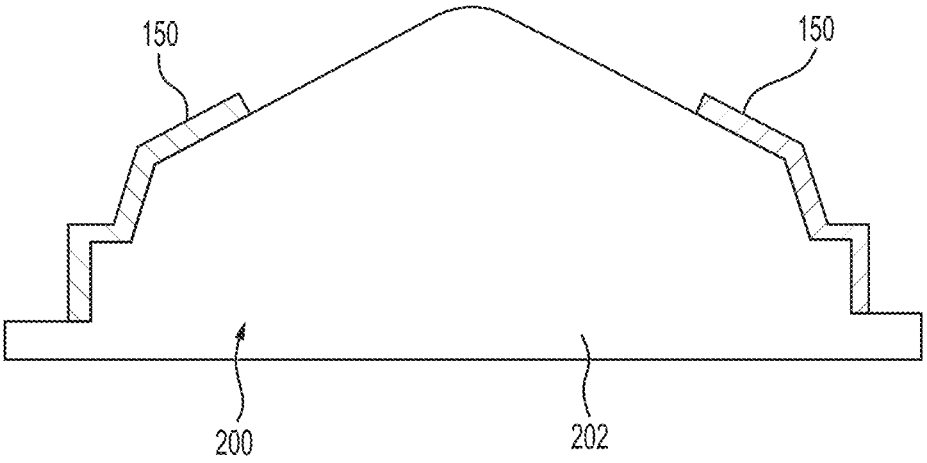
FIGS. 10 to 13 are cross-sectional views of different steps of a method for molding a hull body of the hull of FIG. 4.

After the preformed sheets 150 are sized as desired, as shown in FIG. 10, the preformed sheets 150 are placed into the mold 200 at locations of the mold 200 corresponding to the port and starboard sides 31, 33 of the hull body 15. It is to be understood that the configuration of the mold 200 has been simplified in the Figures since its particular configuration is not important to the presently described method of molding the hull body 15. It is thus understood that the mold 200 may be configured differently in accordance with a desired design of the hull body 15. For instance, the mold 200 may comprise additional parts, or the parts of the mold that are illustrated may be composed of multiple pieces.

As seen in FIG. 10, the preformed sheets 150 are placed onto a male half 202 of the mold 200 such that, once the hull body 15 is molded, the thermoplastic material TH of the preformed sheets 150 forms part of the inner surface 116 of the hull body 15. Moreover, the preformed sheets 150 are aligned in the mold 200 so that the glass fibers 108 extend generally longitudinally once the hull body 15 is molded.

While the port and starboard portions 102, 104 have been illustrated as being longitudinally continuous in FIG. 7, it is contemplated that the port and starboard portions 102, 104 may be discontinuous in other embodiments. As such, in some embodiments in which multiple preformed sheets 150 are used to form one of the port or starboard portions 102, 104, the preformed sheets 150 may be longitudinally spaced from one another in the mold 200.

Figure 11:
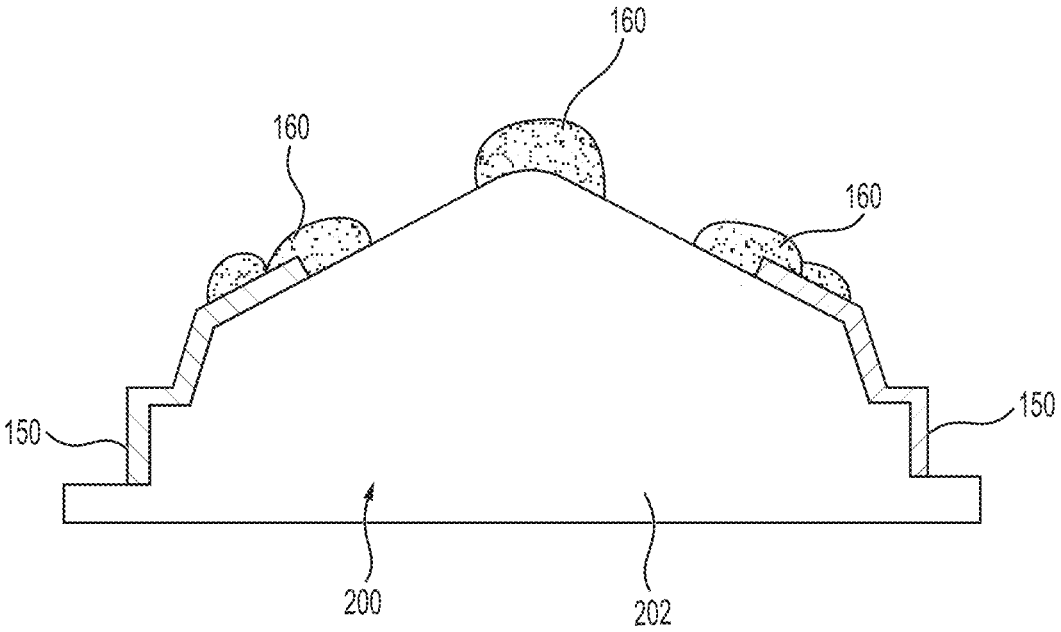

As shown in FIG. 11, once the preformed sheets 150 are in place in the mold 200, deposits 160 comprising a thermoplastic resin embedded with the non-directional chopped glass fibers 106 are placed in the mold 200. More specifically, the deposits 160 are placed atop the male half 202 and/or atop the preformed sheets 150 that are already in place on the male half 202. In this embodiment, the deposits 160 are in the form of semi-solid mounds which are heated prior to being placed into the mold 200. In this embodiment, the deposits 160 are approximately 30% glass by weight. When the hull body 15 is molded, the deposits 160 will form the main portion 100 of the hull body 15.

Figure 12:
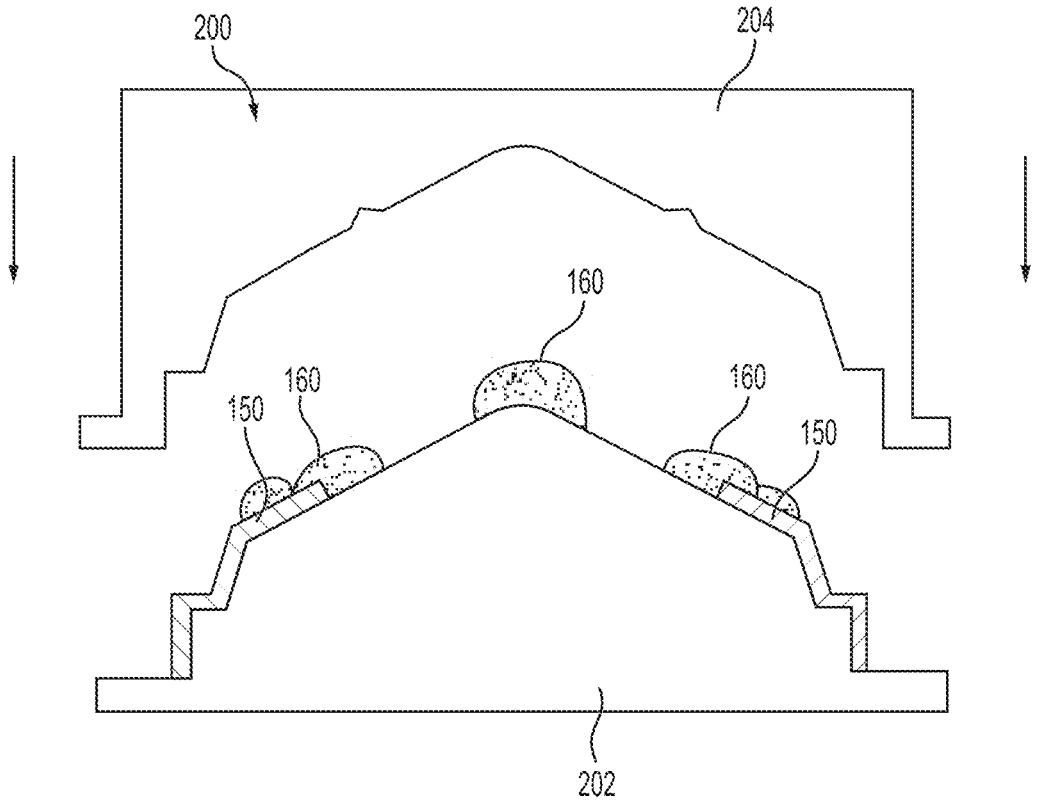
Figure 13:
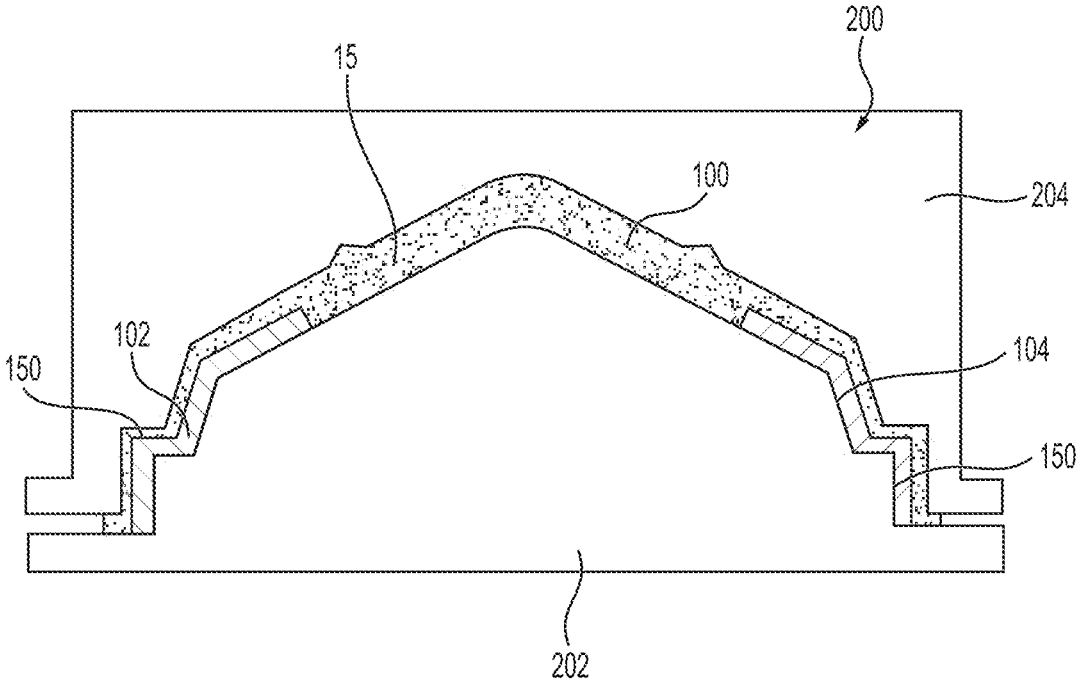

Next, as shown in FIG. 12, the mold 200 is closed by a female half 204 of the mold 200 such that the preformed sheets 150 and the deposits 160 are disposed in a mold cavity formed between the male and female halves 202, 204 of the mold 200. Pressure is then applied to the closed mold 200 in order to force the deposits 160 to spread throughout the mold cavity of the mold 200 and thus fill the mold 200, as shown in FIG. 13. As the resin of the deposits 160 flows through the mold cavity, sections of the mold cavity having a variable thickness are filled by the resin of the deposits 160, including for example sections of the mold 200 corresponding to the strengthening ribs 75, the motor mounts 79 and the brackets 81 (since these sections are not covered by the preformed sheets 150 despite being defined by the male half 202).

It should be noted that as the deposits 160 are compressed in the mold 200 and that the resin of the deposits 160 spreads through the mold cavity, some of the chopped glass fibers 106 of the deposits 160, which were originally non-directional when the deposits 160 were placed in the mold 200, may acquire some directionality. That is, some of the chopped glass fibers 106 can become oriented in the direction of flow of the resin of the deposits 160. This can lead to sections of the main portion 100 of the hull body 15 having the chopped glass fibers 106 with a certain directionality which can cause these sections to be weakened in certain directions relative to other non-directional sections of the main portion 100. This effect is compounded with larger molds as the resin of the deposits 160 may have to flow further, leading to increased directionality of the chopped glass fibers 106. As will be explained below, these weakened sections are countered by the preformed sheets 150.

In this embodiment, the heat transferred from the preheated deposits 160 to the preformed sheets 150 is sufficient to cause the preformed sheets 150 to conform to the mold 200 and cause the thermoplastic material TH of the preformed sheets 150 to fuse with the thermoplastic resin of the deposits 160 as their polymer strands bond to one another. Thus, in this embodiment, the mold 200 is not heated by an external heat source other than the heat provided by the preheated deposits 160. However, it is contemplated that, in some embodiments, the mold 200 may be heated to cause the thermoplastic resin of the deposits 160 and the thermoplastic material TH of the preformed sheets 150 to soften and fuse together and/or the thermoplastic material TH may be directly heated using other means. It should also be noted that, in this embodiment, no catalyst ingredient is used to activate the curing process as is often the case in conventional molding techniques involving thermosetting resins.

The thermoplastic resin of the deposits 160 thus solidifies as the thermoplastic material TH which is the same as the thermoplastic material TH of the preformed sheets 150. Since the thermoplastic material TH of the deposits 160 is the same as the thermoplastic material TH of the preformed sheets 150, as briefly mentioned above, once the compression molding process is complete, the hull body 15 has no clear demarcation between the thermoplastic material TH of the deposits 160 and the thermoplastic material TH of the preformed sheets 150, as shown in FIG. 9. However, the main portion 100 can be differentiated from the port and starboard portions 102, 104 by observing the orientations and lengths of the chopped glass fibers 106 and the directional glass fibers 108, 110.

Certain post-molding operations are performed once the hull body 15 has been molded in the mold 200. For example, the formed hull body 15 undergoes a deflashing operation to remove excess material therefrom.

The hull body 15 resulting from the molding process described above has sections which have a greater amount of glass fibers oriented in one or more particular directions. In particular, the port and starboard portions 102, 104 reinforce those parts of the main portion 100 which may be weakened due to the directionality acquired by some of the chopped glass fibers 106. Notably, such weakened sections of the main portion 100 tend to materialize on the port and starboard sides 31, 33 as the chopped glass fibers 106 in parts of the port and starboard sides 31, 33 (e.g., near the upper edge 112) can become somewhat vertically-oriented. However, the longitudinally-extending glass fibers 108 and the vertically-extending glass fibers 110 provide greater strength in those sections, thus increasing resistance to longitudinal bending and compression, as well as resistance to impacts normal to the plane of the hull body 15 in those weakened sections. In particular, the longitudinally-extending glass fibers 108 provide strength along the longitudinal direction which, due to the direction in which the deposits 160 flow during molding, the main portion 100 can lack along parts of the port and starboard sides 31, 33. Moreover, the higher glass percentage of the preformed sheets 150 in itself reinforces those weakened sections of the main portion 100.

Furthermore, while a straightforward solution to the weakened sections caused by the directionality of the chopped glass fibers could be to simply thicken the hull body 15 in those sections, it would also increase the cost and the weight of the hull body 15, thus negating some of the advantages of using light and inexpensive thermoplastic material to make the hull body 15 in the first place. The implementation of the port and starboard portions 102, 104 thus provides an alternative lighter and lower cost solution for producing the hull body 15 while countering the weakened sections of the main portion 100.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A hull for a personal watercraft, comprising:

a compression-molded hull body having a length between about 2 and 4 meters, a width between about 0.75 and 1.5 meters and a depth between about 0.25 and 1 meters, the hull body defining:

a bow;

a stern opposite the bow;

a laterally centered keel; and a port side and a starboard side extending on opposite sides of the keel;

the hull body comprising:

a main portion comprising a thermoplastic material embedded with non-directional chopped glass fibers, the main portion extending along an entirety of the length of the hull body and an entirety of the width of the hull body; and port and starboard portions comprising the thermoplastic material embedded with directional glass fibers, the directional glass fibers comprising longitudinally-oriented glass fibers, a majority of the longitudinally-oriented glass fibers having a length being at least ten times greater than a mean length of the chopped glass fibers, the port portion extending along the port side, the starboard portion extending along the starboard side, each of the port and starboard portions extending vertically from proximate an upper edge of the hull towards the keel, and extending longitudinally along at least 50% of the length of the hull body.

2. The hull of claim 1, wherein each of the port and starboard portions extends longitudinally along at least 60% of the length of the hull body.

3. The hull of claim 1, wherein each of the port and starboard portions extends longitudinally forward from proximate the stern.

4. The hull of claim 1, further comprising a port side chine and a starboard side chine, the port and starboard portions extending vertically lower than a corresponding one of the port and starboard side chines.

5. The hull of claim 1, wherein each of the port and starboard portions extends vertically along at least 50% of the depth of the hull body.

6. The hull of claim 1, wherein:

the hull body has an inner surface and an outer surface; and the port and starboard portions extend along the inner surface.

7. The hull of claim 6, wherein the main portion defines the outer surface of the hull body.

8. The hull of claim 7, wherein:

the main portion defines the bow, the stern, the keel, an outer portion of the port side and an outer portion of the starboard side;

the port portion defines an inner portion of the port side; and the starboard portion defines an inner portion of the starboard side.

9. The hull of claim 1, wherein the directional glass fibers in the port and starboard portions further comprise vertically-oriented glass fibers extending generally perpendicular to the longitudinally-oriented glass fibers.

10. The hull of claim 9, wherein each of the port and starboard portions further comprises a plurality of layers stacked along a thickness of the hull body, the plurality of layers including:

a first layer containing a first set of the longitudinally-oriented glass fibers;

a second layer containing the vertically-oriented glass fibers; and a third layer containing a second set of the longitudinally-oriented glass fibers, the second layer being disposed between the first layer and the third layer.

11. The hull of claim 1, wherein the thermoplastic material is polypropylene.

12. The hull of claim 1, wherein:

the hull body further defines at least one of strengthening ribs and motor mounts;

the at least one of the strengthening ribs and the motor mounts are formed by the thermoplastic material embedded with non-directional chopped glass fibers; and none of the at least one of the strengthening ribs and the motor mounts are formed by the port and starboard portions.

13. The hull of claim 1, wherein the longitudinally-oriented glass fibers make up a majority of the directional glass fibers.

14. A method for compression molding a hull body for a personal watercraft, the method comprising:

sizing preformed sheets of a thermoplastic material embedded with longitudinally-oriented glass fibers such that the preformed sheets extend along at least 50% of a length of the hull body;

placing the preformed sheets into a mold at locations of the mold corresponding to port and starboard sides of the hull body;

placing in the mold deposits of a thermoplastic resin embedded with non-directional chopped glass fibers, a majority of the longitudinally-oriented glass fibers having a length that is at least ten times greater than a mean length of the chopped glass fibers; and closing the mold and applying pressure thereto such that the thermoplastic resin embedded with non-directional chopped glass fibers of the deposits fills the mold and the thermoplastic material of the preformed sheets fuses with the thermoplastic resin of the deposits which then solidifies as a thermoplastic material.

15. The method of claim 14, wherein the preformed sheets are placed onto a male half of the mold such that the thermoplastic material of the preformed sheets forms part of an inner surface of the hull body.

16. The method of claim 14, wherein the preformed sheets are sized to extend along at least 60% of the length of the hull body.

17. The method of claim 14, wherein the preformed sheets are placed into the mold to extend longitudinally forward from proximate a stern of the hull body.

18. The method of claim 14, wherein the preformed sheets are placed into the mold such that the thermoplastic material of the preformed sheets extends vertically from proximate an upper edge of the hull body towards a keel of the hull body.

19. The method of claim 14, wherein the preformed sheets are placed into the mold such that the thermoplastic material of the preformed sheets extends vertically between port and starboard chines of the hull body and a keel of the hull body.

20. The method of claim 14, wherein the preformed sheets are placed into the mold such that the thermoplastic material of the preformed sheets extends vertically along at least 50% of a height of the hull body.

21. The method of claim 14, wherein the thermoplastic material of the preformed sheets is further embedded with vertically-oriented glass fibers extending generally perpendicular to the longitudinally-oriented glass fibers.

* * * * *